US005146277A

United States Patent [19]

Fox et al.

[11] Patent Number: 5,146,277

[45] Date of Patent: Sep. 8, 1992

[54] DUAL-FLOW RIBBON BLENDER HAVING INTERSTREAM MIXING MEMBER

[75] Inventors: Richard S. Fox, Rochester; Frederick J. Case, Hamlin, both of N.Y.

[73] Assignee: Eastman Kodak Company, Rochester, N.Y.

[21] Appl. No.: 763,386

[22] Filed: Sep. 20, 1991

[51] Int. Cl.[5] ..... G03G 15/06

[52] U.S. Cl. ..... 355/245; 118/653; 222/412; 222/DIG. 3; 366/320

[58] Field of Search ..... 355/245, 260; 222/412, 222/DIG. 1; 366/320, 321

[56] References Cited

U.S. PATENT DOCUMENTS 4,825,244 4/1989 Hediger ..... 355/245
4,887,132 12/1989 Joseph et al. ..... 355/253
4,956,675 9/1990 Joseph ..... 355/251
4,974,023 11/1990 Aimoto et al. ..... 355/245
4,980,724 12/1990 Tanaka ..... 355/245
4,996,565 2/1991 Herley ..... 355/245
5,016,053 5/1991 Ibuchi et al. ..... 355/245

*Primary Examiner*—A. T. Grimley
*Assistant Examiner*—P. J. Stanzione
*Attorney, Agent, or Firm*—Tallam I. Nguti

[57] ABSTRACT

A developer material mixing blender includes a shaft and self-locking segments. Each segment has a hollow hub, an inner ribbon for moving material towards one end, an outer ribbon for moving material in a second stream towards another and opposite end, and an interstream cross-mixing rib for moving material laterally from one to the other of the first and second streams in order to insure good mixing.

7 Claims, 2 Drawing Sheets

DUAL-FLOW RIBBON BLENDER HAVING INTERSTREAM MIXING MEMBER

BACKGROUND OF THE INVENTION

1. Field of the Invention

This invention relates generally to development apparatus for mixing and applying developer material to a latent image on an image-bearing member in an electrostatographic reproduction machine, such as a copier or printer. More particularly, this invention relates to such a development apparatus that includes a dual-flow developer material mixing ribbon blender which has an interstream mixing member.

2. Description Relative to the Prior Art

Development apparatus, for example a magnetic brush development apparatus are well known for mixing and applying developer material to a latent image in an electrostatographic reproduction machine such as a copier or printer. Such a development apparatus typically includes an elongate housing which has a sump portion for containing the developer material. Where the developer material comprises a mixture of carrier particles and toner particles, these particles are usually moved and mixed by a mixing device in the sump portion of the housing for triboelectrically charging the particles, as well as for achieving uniformity for example (a) in the concentration of toner particles throughout the sump portion, and (b) in the distribution of developer material within the sump. The mixed and charged developer material can then be fed from the sump portion for application to, or development of the latent image.

The quality of such an application or image development depends, in significant part, on factors such as the level of charge on the toner particles achieved triboelectrically for example, and such as the level and uniformity of the concentration of toner particles in the developer material being applied. As is well known, these factors are mainly determined by the effectiveness of a mixing device used in the sump portion of the development apparatus housing for moving, mixing and charging the developer material particles.

Various such mixing devices are disclosed, for example, in U.S. Pat. Nos. 5,016,053 issued May 14, 1991 to Ibuchi et al; 4,996,565 issued Feb. 26, 1991 to Herley; 4,980,724 issued Dec. 25, 1990 to Tanaka; 4,974,023 issued Nov. 27, 1990 to Aimoto et al; and 4,956,675 issued Sep. 11, 1990 to Joseph. The single mixing device disclosed in the Joseph Pat. No. 4,956,675 is a dual-direction flow ribbon blender and thus can be advantageously used in a single sump development apparatus.

Conventional dual-flow ribbon blenders as disclosed for example in the Joseph Pat. No. 4,956,675 unfortunately tend to create problems such as non-uniform distribution of freshly added toner particles to developer material in the sump of the host development apparatus, and long term uneven distribution or accumulation of developer material within such a sump. The net result is uneven toner concentration and even poor image development. These problems are believed to be associated (a) with difficulties in balancing for example the inner flow rate of developer material in one direction with the outer flow rate of the same in an opposite direction, and (b) with the inner flow stream of developer material being essentially parallel to the outer flow stream thereof.

SUMMARY OF THE INVENTION

It is an object of the present invention to provide in a development apparatus of an electrostatographic reproduction machine, a mixing device that substantially overcomes the difficulties and problems cited above.

In accordance with the present invention a mixing device is provided in a development apparatus of an electrostatographic reproduction machine and comprises a rotatable shaft, and first inner and second outer helical ribbons. The first helical ribbon is rotatable with the shaft for moving developer material forming a first inner flow stream of such material to a first direction along the axis of the shaft. The second helical ribbon is also rotatable with the shaft for moving the developer material forming a second outer flow stream of such material to a second and opposite direction along the axis of the shaft. The mixing device also comprises a plurality of interstream mixing members located axially along the shaft for causing developer material to move from one to the other of the inner and outer flow streams of such developer material. The plurality of interstream mixing members comprises axial ribs spaced axially on the shaft for rotation therewith.

BRIEF DESCRIPTION OF THE DRAWINGS

In the detailed description of the invention presented below, reference is made to the drawings, in which.

DETAILED DESCRIPTION OF THE PREFERRED EMBODIMENT

Because electrostatographic development apparatus are well known, the present description will be directed in particular to development apparatus elements forming part of or cooperating more directly with the present invention. Elements not specifically shown or described herein are selectable from those known in the prior art.

Figure 1:
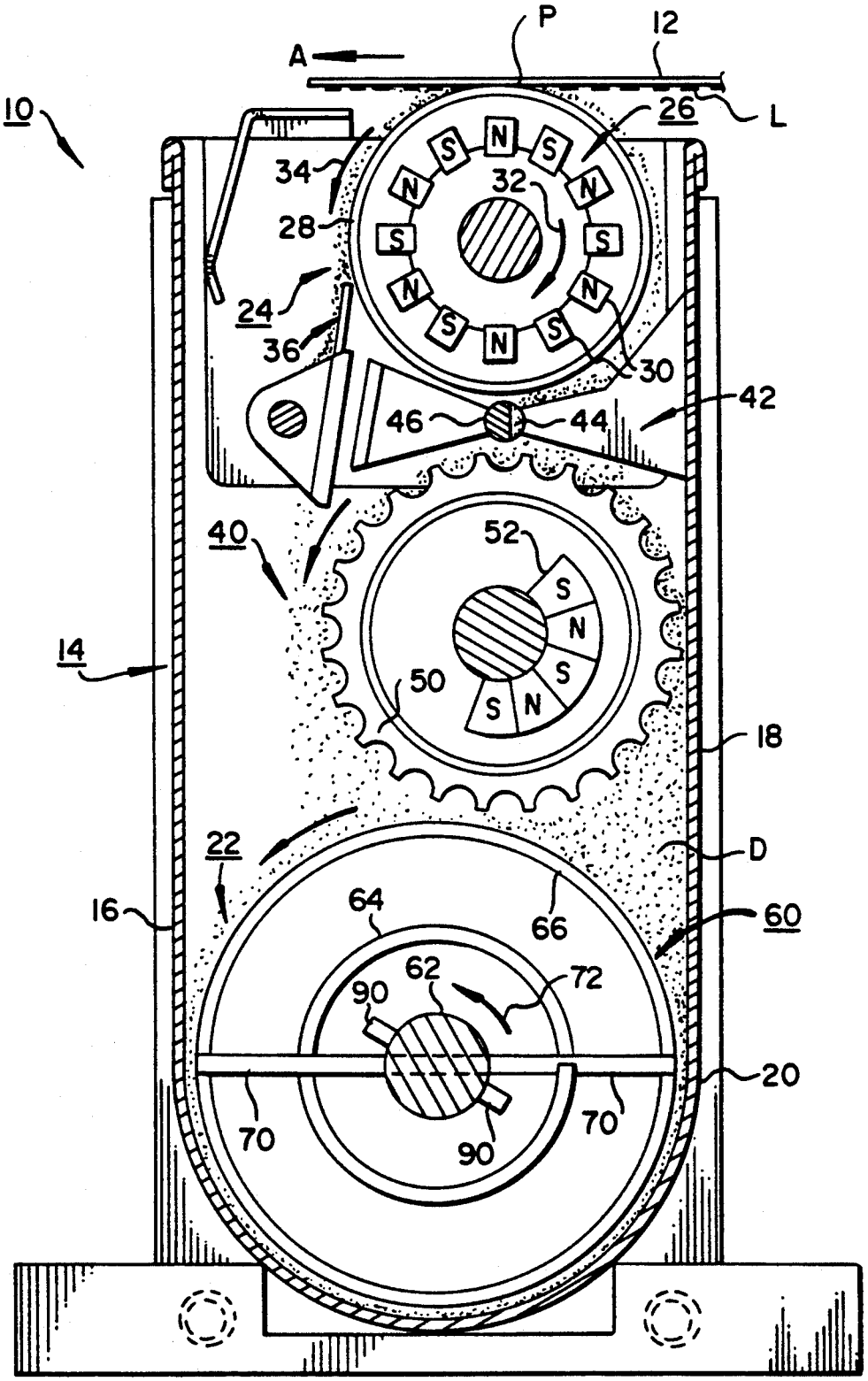
FIG. 1 is an elevational view, partly in section, of the magnetic brush development apparatus of the present invention.

Referring now to FIG. 1, the development apparatus of the present invention is shown generally as 10, and is adapted for developing electrostatic latent images L on an image-bearing member 12. Image-bearing member 12 can be discrete image receiver sheets, or part of an endless photoconductive web as shown, being moved in the direction of arrow A. The development apparatus 10 comprises an elongate housing 14 which has side walls 16 and 18, and a bottom wall 20 that defines a single elongate sump portion 22 for containing developer material D. Developer material D for example can be single component or multiple component comprising magnetic carrier particles and pigmented marking or toner particles. Development apparatus 10 also comprises developing means 24 supported within the top portion of the housing 14 where such means 24 project through an opening for applying charged developer material particles, within a development nip P, to the latent images L on the member 12.

As shown, developing means 24 can comprise a magnetic brush including a rotatable magnetic core 26 and a rotatable non-magnetic shell 28 which surrounds the core 26. The magnetic core 26 includes a plurality of alternating N-S pole magnets 30, and can be rotated in the clockwise direction, for example, as shown by the arrow 32. As is well known, rotation of such a magnetic core 26 in the clockwise direction, for example, will cause magnetic carrier particles of the developer material D on the surface of the shell 28 to travel over the shell 28 in the opposite or counterclockwise direction. As shown, the shell 28 can then also be rotated, for example, in the counterclockwise direction as shown by the arrow 34 in order to assist such movement of developer material D through the image development nip P. Following image development within the nip P, spent developer material on the shell 28 can be skived off or removed therefrom by a skive 36 for return to the sump 22.

The development apparatus 10 also comprises feed means 40 supported between the sump portion 22 of the housing 14 and the image developing means 24 for feeding developer material D from the sump portion 22 to the developing means 24. A metering assembly shown as 42 may be mounted between the feed means 40 and the developing means 24. Metering assembly 42, for example, includes an elongate member having a generally cylindrical feed slot 44 and a rotatable D-shaped rod 46 mounted within such slot 44 for selectively controlling the flow of developer material therethrough. Developer material D containing magnetic carrier particles when brought by the feed means 40 into the magnetic influence of the magnets 30 of the core 26 will be attracted through the slot 44 onto the shell 28 for movement thereafter as described above.

Feed means 40 can comprise a rotatable non-magnetic shell 50, having external recesses or grooves as shown. Within the shell 50 are mounted a plurality of stationary magnets 52 that extend partially about 160° counterclockwise from a position just directly above the sump portion 22 to a position adjacent the metering slot 44 of metering assembly 42. As such, charged developer material D from the sump portion 22 is attracted and held onto the outside of the shell 50 under the influence of such magnets 52 for movement by the shell 50 past the slot 44.

Figure 2:
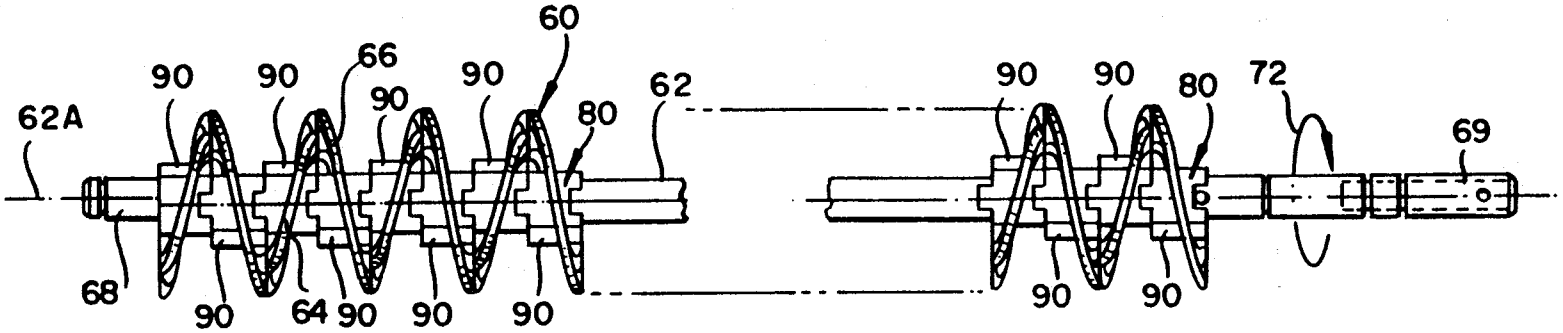
FIG. 2 is a broken side view of the mixing device of the present invention.
Figure 4:
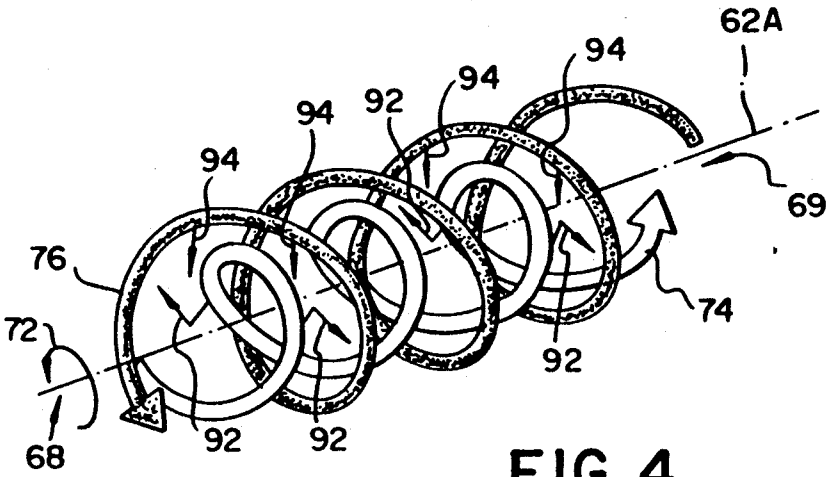
FIG. 4 is a schematic showing the flow pattern of developer material being moved and mixed by the mixing device of the present invention.

For moving, mixing and triboelectrically charging the developer material D within the sump 22, the development apparatus 10 further comprises a ribbon blender or mixing device 60. Referring now to FIGS. 1–2 and 4, the mixing device 60 which is mounted rotatably within the sump 22, includes a rotatable shaft 62 having an axis 62A, a first end 68, and a second end 69. The device 60 also includes a first, inner helical ribbon 64 and a second, outer helical ribbon 66. The first and second helical ribbons 64, 66 are supported as shown by a plurality of rods 70.

The first and second helical ribbons 64, 66 are coiled concentrically and oppositely about the shaft 62, and are rotatable therewith. Each helical ribbon 64, 66 has a pitch angle such that when the shaft 62 is rotated for example in the direction of the arrow 72, each helical ribbon 64, 66 will move developer material D in the form of a stream thereof axially relative to the shaft 62. The pitch angles are such that rotation of the shaft 62 in this manner will cause the first helical ribbon 64 to move some of the developer material D in the form of a first and inner developer material flow stream 74 to a first direction from the first end 68 towards the second 69 of the shaft 62. At the same time, such rotation causes the second helical ribbon 66 to move some of the developer material D in the form of a second and outer developer material flow stream 76 to a second and opposite direction from the second end 69 back towards the first end 68 of the shaft 62.

Figure 3:
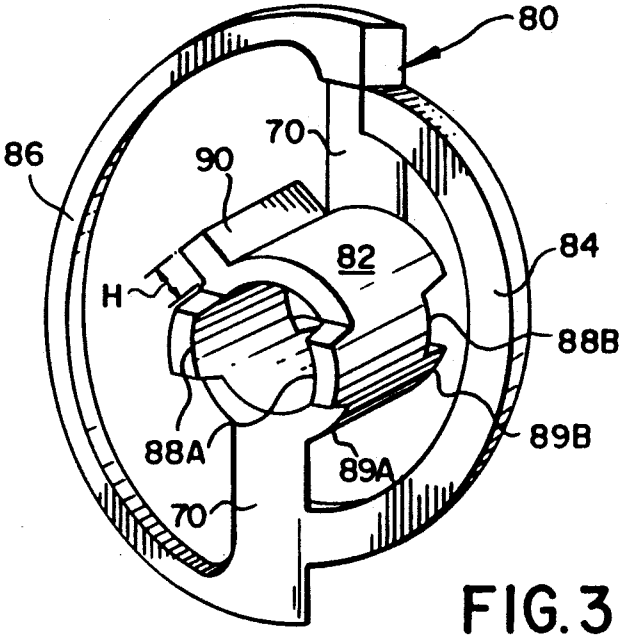
FIG. 3 is an enlarged perspective view of one ribbon segment of the mixing device of FIG. 2.

Referring now to FIGS. 2, 3 and 4, the mixing device 60, as such, is comprised of a plurality of ribbon segments each shown as 80 that are mounted axially on the shaft 62 between the first and second ends 68, 69 thereof. Each segment includes a hollow hub portion 82 for mounting over the shaft 62, a first helical ribbon section 84, and a second helical ribbon section 86. The hub 82 has means 88A, 88B at first and second ends 89A, 89B thereof for interlocking adjacent ribbon segments 80 when assembled on the shaft 62. The interlocking means **88*a* are projections and those 88B are complementary receiving recesses such that the projections 88A of one segment fit snugly into the recesses 88B of an adjacent segment during assembly. As shown, the first helical ribbon section 84 is connected to the rod 70 and is coiled in a first direction about the hub 82 so as to have a first radius (not labeled) about the axis of the hub 82. The second helical ribbon section 86 is also connected to the rod 70, coiled in a second and opposite direction, and has a second similar radius (not labeled) that is greater than the first radius of the section 84. When interlocked by the means 88A, 88B on the shaft 62, the first and second helical ribbon sections 84, 86 form the first and second helical ribbons 64, 66**.

As disclosed, the mixing device or ribbon blender 60 when mounted and rotated in the sump 22 (FIG. 1) will cause the first and second flow streams 74, 76 (FIG. 4) of developer material to move as described above. Ordinarily, however, the flow streams 74, 76 will move essentially parallel to each other, and the flow rates of developer material in each stream may substantially not be equal, thus resulting in an unbalancing of the distribution of developer material between the ends of the sump portion 22. Such an unbalanced distribution, of course, affects the uniformity or lack thereof, of the concentration of toner particles newly added for replenishment to the developer material D in the sump 22.

Therefore, according to the present invention, the mixing device or ribbon blender 60 further comprises a plurality of interstream mixing members shown as 90 that are located axially along the shaft 62 for causing some of the developer material to move from one to the other of the otherwise substantially parallel flow streams 74, 76. As shown, the plurality of interstream mixing members comprises axial ribs which are spaced axially on the shaft 62 for rotation therewith. Each axial rib has a height or dimension H proximately from the shaft 62 that is less than the radial distance of the first, inner helical ribbon 64, from the shaft. The height or dimension H as shown is essentially the distance by which the axial rib projects from the hub portion 82 of each ribbon segment. As shown in FIGS. 2 and 3, the interlocking means 88A, 88B are formed such that each means 88A can fit in either of the means 88B thus allowing 180° offset assembling of identical ribbon segments 80 along the shaft 62. As a result, the axial ribs 90 of adjacent ribbon segments 80 mounted as such on the shaft 62 can be alternately (FIG.2) offset 180° circumferentially thereon relative to each other.

In operation, the interstream mixing members 90 function to move some developer material in a lateral manner as indicated by the arrows 92, from the inner developer material flow stream 74 outwardly towards the outer flow stream 76. At least in the top half of the sump 22, such movement laterally of developer material from stream 74 towards stream 76 creates a void within the inner stream 74 close to the axis of the mixing device 60 which is then quickly filled by developer material collapsing (arrows 94) into the void from the above outer flow stream 76. As such, developer material is caused to move laterally from one to the other of the oppositely flowing axial developer material streams 74, 76. Such interstream mixing between the ends 68, 69 of mixing device 60 is believed to produce an improved end-to-end distribution of developer material D within the sump 22, as well as improved uniformity of toner concentration in such developer material. The invention has been described in detail with particular reference to a presently preferred embodiment, but it will be understood that variations and modifications can be effected within the spirit and scope of the invention.

What is claimed is:

1. In a development apparatus of an electrostatographic reproduction machine, a mixing device for moving and mixing developer material, the mixing device comprising:

(a) a rotatable shaft;

(b) a first helical ribbon rotatable with said shaft;

(c) a second helical ribbon also rotatable with said shaft; and (d) a plurality of interstream mixing members located axially along said shaft for causing developer material to move from a first developer material flow stream associated with said first helical ribbon to a second developer material flow stream associated with said second helical ribbon, said plurality of interstream mixing members comprising axial ribs spaced axially on said shaft for rotation therewith, each said axial rib having a height from said shaft less than the radial distance of said first and said second helical ribbons from said shaft.

2. The mixing device of claim 1 wherein each said axial rib is offset 180° circumferentially about said shaft from an adjacent axial rib.

3. In a development apparatus of an electrostatographic reproduction machine, a mixing device for moving and mixing developer material, the mixing device comprising:

(a) a rotatable shaft;

(b) means, including a first helical ribbon for moving developer material forming a first stream thereof to a first direction along the axis of said shaft;

(c) means including a second helical ribbon for moving the developer material forming a second stream thereof to a second and opposite direction along the axis of said shaft; and (d) a plurality of interstream mixing members located axially along said shaft for causing developer material to move from one to the other of said first and second flow streams of such developer material, said plurality of interstream mixing members comprising axial ribs spaced axially on said shaft rotation therewith, each said axial rib alternately being offset 180° circumferentially about said shaft from an adjacent axial rib.

4. The mixing device of claim 3 wherein said first and said second helical ribbons are coiled oppositely and concentrically around said shaft.

5. The mixing device of claim 4 comprising a plurality of ribbon segments mounted on said shaft, each ribbon segment including:

(a) a hollow hub portion for mounting onto said shaft;

(b) a first helical ribbon section coiled in a first direction about said hub portion;

(c) a second helical ribbon section coiled in a second and opposite direction about said hub portion, said first and second helical ribbon sections being concentric and connected to said hub portion for forming said first and second helical ribbons;

(d) means for interlocking adjacent ribbon segments; and (e) an axially extending rib formed on said hub portion, and said axially extending rib having a height above said hub less than the distance between said hub and said first and said second helical ribbon sections.

6. The mixing of claim 5 wherein axially extending ribs of adjacent ribbon segments mounted on said shaft are offset 180° thereabout relative to each other.

7. A development apparatus for developing an electrostatic latent image on an image-bearing member in an electrostatographic reproduction machine, the development apparatus comprising:

(a) a housing including a sump portion for containing developer material particles;

(b) developing means supported within a top portion of said housing for applying charged developer material particles to the electrostatic latent image;

(c) feed means for feeding such charged developer material particles from said sump portion of said housing to said developing means; and (d) a mixing device mounted in said sump portion for moving, mixing and triboelectrically charging the developer material particles contained within said sump portion, said mixing device comprising:

(i) a rotatable shaft;

(ii) a first helical ribbon rotatable with said shaft for moving developer material forming a first stream thereof to a first direction along the axis of said shaft;

(iii) a second helical ribbon also rotatable with said shaft for moving the developer material forming a second stream thereof to a second and opposite direction along the axis of said shaft; and (iv) a plurality of interstream mixing members located axially and alternately along said shaft for causing developer material to move from one to the other of said first and second flow streams of such developer material, said plurality of interstream mixing members comprising axial ribs spaced axially on said shaft for rotation therewith, and each said axial rib being offset 180° circumferentially about said shaft from an adjacent axial rib.

* * * * *